US005500900A

United States Patent [19]

Chen et al.

[11] Patent Number: 5,500,900

[45] Date of Patent: Mar. 19, 1996

[54] METHODS AND APPARATUS FOR PRODUCING DIRECTIONAL SOUND

[75] Inventors: Jiashu Chen, Madison; Barry P. VanVeen, McFarland; Kurt E. Hecox, Madison, all of Wis.

[73] Assignee: Wisconsin Alumni Research Foundation, Madison, Wis.

[21] Appl. No.: 311,213

[22] Filed: Sep. 23, 1994

Related U.S. Application Data

[63] Continuation of Ser. No. 968,562, Oct. 29, 1992, abandoned.

[51] Int. Cl.[6] ..... H04S 5/00

[52] U.S. Cl. ..... 381/17

[58] Field of Search ..... 381/17, 1

[56] References Cited

U.S. PATENT DOCUMENTS

| | | | |
|---|---|---|---|
| 5,023,913 | 6/1991 | Matsumoto et al. | 381/1 |
| 5,033,086 | 7/1991 | Fidi . | |
| 5,095,507 | 3/1992 | Lowe | 381/17 |
| 5,105,462 | 4/1992 | Lowe et al. | 381/17 |
| 5,187,692 | 2/1993 | Haneda et al. | 367/135 |

FOREIGN PATENT DOCUMENTS

| | | | |
|---|---|---|---|
| 0249640 | 12/1987 | European Pat. Off. | H04S 3/02 |
| 3934671A | 4/1990 | Germany | H04R 5/00 |
| 3922118A1 | 1/1991 | Germany | H04R 5/00 |

OTHER PUBLICATIONS

PCT Written Opinion dated 8 Nov. 1994, International Application No. PCT/US94/01840.

C. Posselt, et al., "Generation of Binaural Signals for Research and Home Entertainment," Proc. 12th Int. Cong. Accoustics B1–6.

Oppenheim and Schafer, *Discrete Time Signal Processing* (book), Prentice Hall, 1989, pp. 230–250.

Richard J. Kaufman, "Frequency Contouring for Image Enhancement," Audio, Feb. 1985, pp. 34–39.

William L. Martens, "Principal Components Analysis and Resynthesis of Spectral Cues to Perceived Direction," 1987 ICMC Proceedings (International Computer Music Conference), 1987, pp. 274–281.

Frederic L. Wightman, Doris J. Kistler, "Headphone Simulation of Free–Field Listening. I: Stimulus Synthesis," J. Acoust. Soc. Am., vol. 85, No. 2, Feb. 1989, pp. 858–867.

Frederic L. Wightman, Doris J. Kistler, "Headphone Simulation of Free–Field Listening. II: Psycholophysical Validation," J. Acoust. Soc. Am., vol. 85, No. 2, Feb. 1989, pp. 868–878.

Elizabeth M. Wenzel, Scott H. Foster, Frederick L. Wightman, Doris J. Kistler, "Realtime Digital Synthesis of Localized Auditory Cues Over Headphones" Proceedings of the ASSP (IEEE) Workshop on Applications of Signal Processing to Audio & Acoustics, New Paltz, New York, 1989.

Scott H. Foster, Elizabeth M. Wenzel, R. Michael Taylor, "Real Time Synthesis of Complex Acoustic Environments," Proceedings of the ASSP (IEEE) Workshop on Applications of Signal Processing to Audio & Acoustics, New Paltz, New York, 1991.

Frederic Wightman, Doris J. Kistler, Marianne Arruda, "Perceptual Consequences of Engineering Compromises in Syn (List continued on next page.)

*Primary Examiner*—Forester W. Isen

*Attorney, Agent, or Firm*—Foley & Lardner

[57] ABSTRACT

Free-field-to-eardrum transfer functions (FETF's) are developed by comparing auditory data for points in three-dimensional space for a model ear and auditory data collected for the same listening location with a microphone. Each FETF is represented as a weighted sum of frequency-dependent functions obtained from an expansion of the measured FETF's covariance matrix. Spatial transformation characteristic functions (STCF's) are applied to transform the weighted frequency-dependent factors to functions of spatial variables for azimuth and elevation. A generalized spline model is fit to each STCF to filter out noise and permit interpolation of the STCF between measured points. Sound is reproduced for a selected direction by synthesizing the weighted frequency-dependent factors with the smoothed and interpolated STCF's.

27 Claims, 7 Drawing Sheets

OTHER PUBLICATIONS thesis of Virtual Auditory Objects," (Abstract), J. Acoust. Soc. Am., vol. 92, No. 4, Pt. 2, Oct. 1992, p. 2332.

John C. Middlebrooks, David M. Green, "Observations on a Principal Components Analysis of Head–Related Transfer Functions," J. Acoust. Soc. Am., vol. 92, No. 1, Jul. 1992, pp. 597–599.

Advertisements by Crystal River Engineering, Inc., Groveland, California, for "Acoustetron" 3–D Audio Workstation, Convolvotron 3–D Audio Reference, and Beachtron Affordable 3–D Audio.

Abstract, Auditory Space Modeling, Journal of Acoustical Society of America meeting. Jiashu Chen, et al.

Kistler, D. J. and Wightman, F. L., "A Model of Head–Related Transfer Functions Based on Principal Components Analysis and Minimum–phase Reconstruction", J. Acoustical Society Am. 91, 1637–1647.

Gu, Chong "Rkpack and Its Applications: Fitting Smoothing Spline Models", Dept. of Statistics, Univ. of WI–Madison, May, 1989.

METHODS AND APPARATUS FOR PRODUCING DIRECTIONAL SOUND

This invention was made with United States Government support awarded by the National Institute of Health (NIH), Grant No. R01 DC 00163. The United States Government has certain rights in this invention.

This is a continuation of application Ser. No. 07/968,562, filed Oct. 29, 1992, abandoned.

BACKGROUND OF THE INVENTION

1. Field of the Invention

The field of the invention is methods and apparatus for detecting and reproducing sound.

2. Description of the Background Art

Extensive physical and behavioral studies have revealed that the external ear (including torso, head, pinna, and canal) plays an important role in spatial hearing. It is known that the external ear modifies the spectrum of incoming sound according to incident angle of that sound. It is further known that in the context of binaural hearing, the spectral difference created by the external ears introduces important cues for localizing sounds in addition to interaural time and intensity differences. When the sound source is within the sagittal plane, or in the case of monaural hearing, the spectral cues provided by the external ear are utilized almost exclusively by the auditory system to identify the location of the sound source. The external ears also externalize the sound image. Sounds presented binaurally with the original time and intensity differences but without the spectral cues introduced by the external ear are typically perceived as originating inside the listener's head.

Functional models of the external ear transformation characteristics are of great interest for simulating realistic auditory images over headphones. The problem of reproducing sound as it would be heard in three-dimensional space occurs in hearing research, high fidelity music reproduction, and voice communication.

Kistler and Wightman describe a methodology based on free-field-to-eardrum transfer functions (FETF's), also known as head related transfer functions (HRTFs), in a paper published in the Journal of the Acoustical Society of America (March, 1992) pp. 1637–1647. This methodology analyzes the amplitude spectrum and the results represent up to 90% of the energy in the measured FETF amplitude. This methodology does not provide for interpolation of the FETF's between measured points in the spherical auditory space around the listener's head, or represent the FETF phase.

For further background art in the relevant area of auditory research, reference is made to the Introduction portion of our article, "External Ear Transfer Function Modeling: A Beamforming Approach", published in the Journal of the Acoustical Society of America, vol. 92, no. 4, Pt. 1 (Oct. 30, 1992) pages 1933–1944.

SUMMARY OF THE INVENTION

The invention is incorporated in methods and apparatus for recording and playback of sound, and sound recordings, in which a non-directional sound is processed for hearing as a directional sound over earphones.

Using measured data, a model of the external ear transfer function is derived, in which frequency dependance is separated from spatial dependance. A plurality of frequency-dependent functions are weighted and summed to represent the external ear transfer function. The weights are made a function of direction. Sounds that carry no directional cues are perceived as though they are coming from a specific direction when processed according to the signal processing techniques disclosed and claimed herein.

With the invention, auditory information takes on a spatial three-dimensional character. The methods and apparatus of the invention can be applied when a listener, such as a pilot, astronaut or sonar operator needs directional information, presented over earphones or they can be used to enhance the pleasurable effects of listening to recorded music over earphones.

Other objects and advantages, besides those discussed above, shall be apparent to those of ordinary skill in the art from the description of the preferred embodiment which follows. In the description, reference is made to the accompanying drawings, which form a part hereof, and which illustrate examples of the invention. Such examples, however, are not exhaustive of the various embodiments of the invention, and therefore reference is made to the claims which follow the description for determining the scope of the invention.

DETAILED DESCRIPTION OF THE PREFERRED EMBODIMENTS

Figure 1:
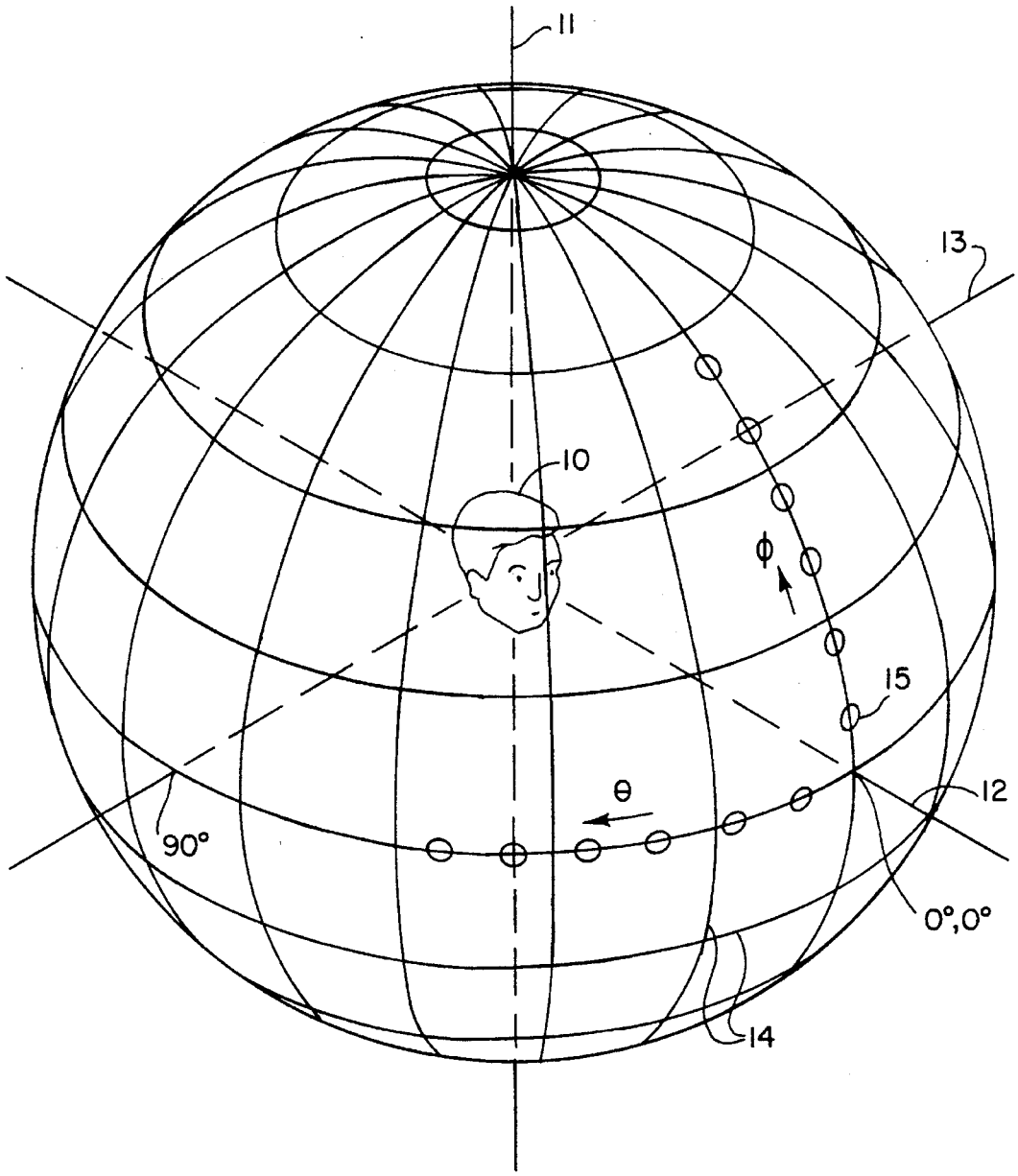
FIG. 1 is a diagram showing how sound data is collected according to the present invention.
Figure 2A:
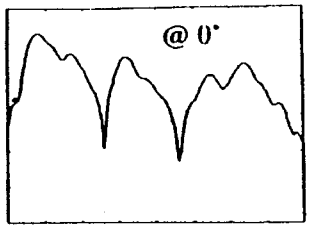
FIGS. 2*a*–2*j* are spectral graphs of sound collected in FIG. 1 or interpolated relative to data collected in FIG. 1.
Figure 2B:
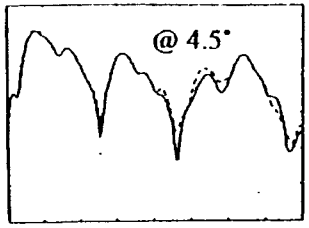
Figure 2C:
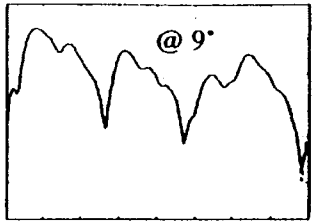
Figure 2D:
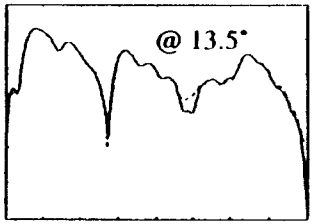
Figure 2E:
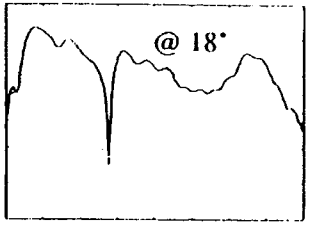
Figure 2F:
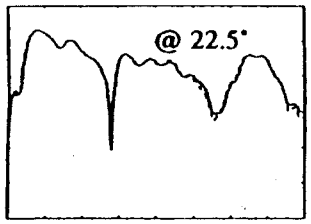
Figure 2G:
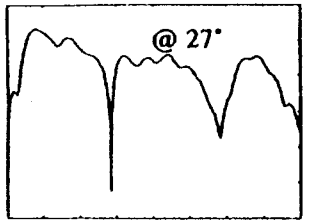
Figure 2H:
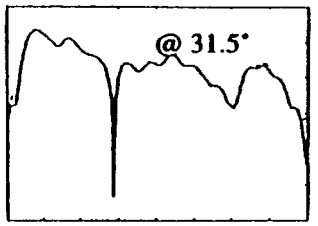
Figure 2I:
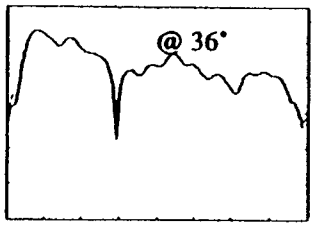
Figure 2J:
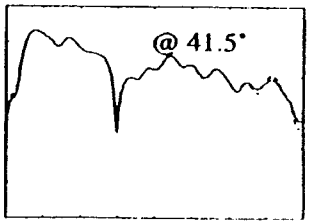

Referring to FIG. 1, the invention utilizes data measured in three-dimensional space relative to a typical human ear. The measurements may be conducted on a human subject, if a specific subject ear is required, or with a special manikin head 10, such as a KEMAR™ head, which represents a typical human ear. The spherical space around the head is described in terms of spherical coordinates $\theta$ and $\phi$. The variable $\theta$ represents azimuth angle readings relative to a vertical midline plane defined by axes 11 and 12 between the two ears (with angles to the right of the midline plane in FIG. 1 being positive angles and with angles to the left being negative angles). The variable $\phi$ represents elevation readings relative to a horizontal plane passing through the axes 12 and 13 and the center of the ears (above this plane being a positive angle and below this plane being a negative angle). Isoazimuth and isoelevation lines 14 are shown in 20° increments in FIG. 1. A speaker 15 is moved to various positions and generates a broadband sound.

The ear sound is measured using the subject's ear or manikin's head 10 by placing a microphone in one ear to record sound as it would be heard by a listener. Data can be taken for both ears. To develop a free-field-to-ear transfer function, sound is also measured without the effects of the ear, by removing the subject's ear or manikin's head 10 and detecting sound at the ear's previous location. This is "free field" sound data. Both measurements are repeated for various speaker locations. Standard signal processing methods are used to determine the transfer function between the ear and the free-field data at each location.

FIGS. 2*a*, 2*c*, 2*e*, 2*g* and 2*i* shows a series of spectral sound graphs (amplitude vs. frequency) for a series of readings for 18.5° elevation, and varying azimuth angles from 0° to 36°. The readings were taken at 9° intervals. A shift in spectral peaks and valleys is observed as the origin of the sound is moved. FIGS. 2*b*, 2*d*, 2*f*, 2*h* and 2*j* show values which have been interpolated using the data and methodology described herein.

Figure 3:
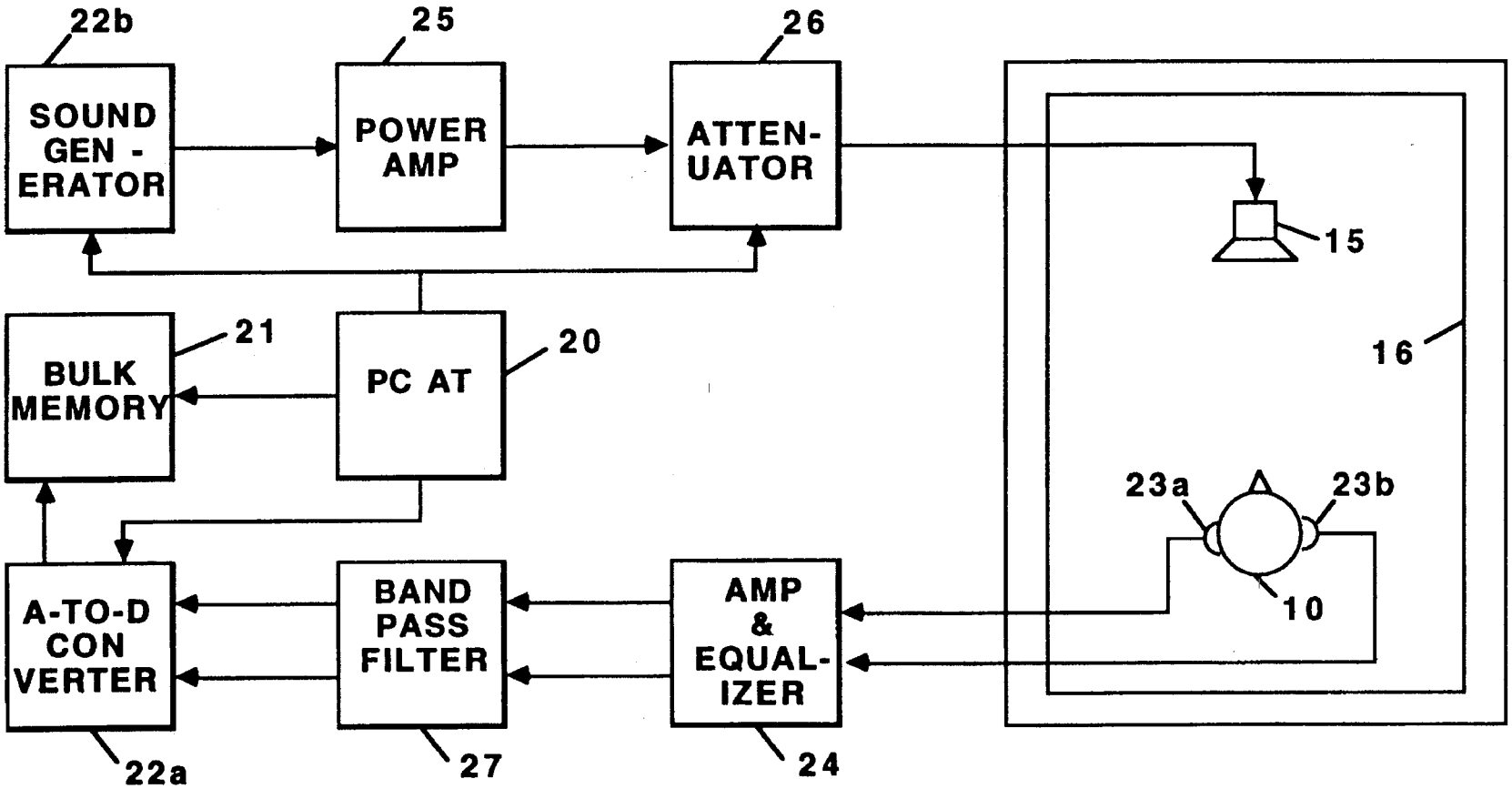
FIG. 3 is a block diagram of the apparatus used to record sound data as depicted in FIGS. 1 and 2.

FIG. 3 illustrates the apparatus for collecting sound data for free-field and ear canal recording. The subject 10 and a movable speaker 15 are placed in a chamber 16 for sound recording. A personal computer 20, such as the IBM PC AT or an AT-compatible computer, includes a bulk memory 21, such as a CD-ROM or one or more large capacity hard drives. Microphones 23*a*, 23*b* are placed in the subject's or manikin's ears. The sound is processed through an amplifier and equalizer unit 24 external to the computer 20 and analog band pass filtering circuitry 27 to an A-to-D converter portion 22*a* of a signal processing board in the computer chassis. There, the analog signals of the type seen in FIG. 2 are converted to a plurality of sampled, digitized readings. Readings are taken at as many as 2000 or more locations on the sphere around the manikin head 10. This may require data storage capacity on the order of 70 Megabytes.

The computer 20 generates the test sound through a sound generator portion 22*b* of the signal processing board. The electrical signal is processed through power amplifier circuitry 25 and attenuator circuitry 26 to raise the generated sound to the proper power level. The sound-generating signal, which is typically a square wave pulse of 30–100 microseconds in duration or other broadband signal is then applied through the speaker 15 to generate the test sound. The speaker 15 is moved from point to point as shown in FIG. 1.

In an alternative embodiment for recording spatial sound data, a VAX 3200 computer is used with an ADQ-32 signal processing board.

In methods and apparatus for recording and playing back simulated directional sound over earphones, an audio input signal is passed through a filter whose frequency response models the free field-to-eardrum transfer function. This filter is obtained as a weighted combination of basic filters where the weights are a function of the selected spatial direction.

Figure 4:
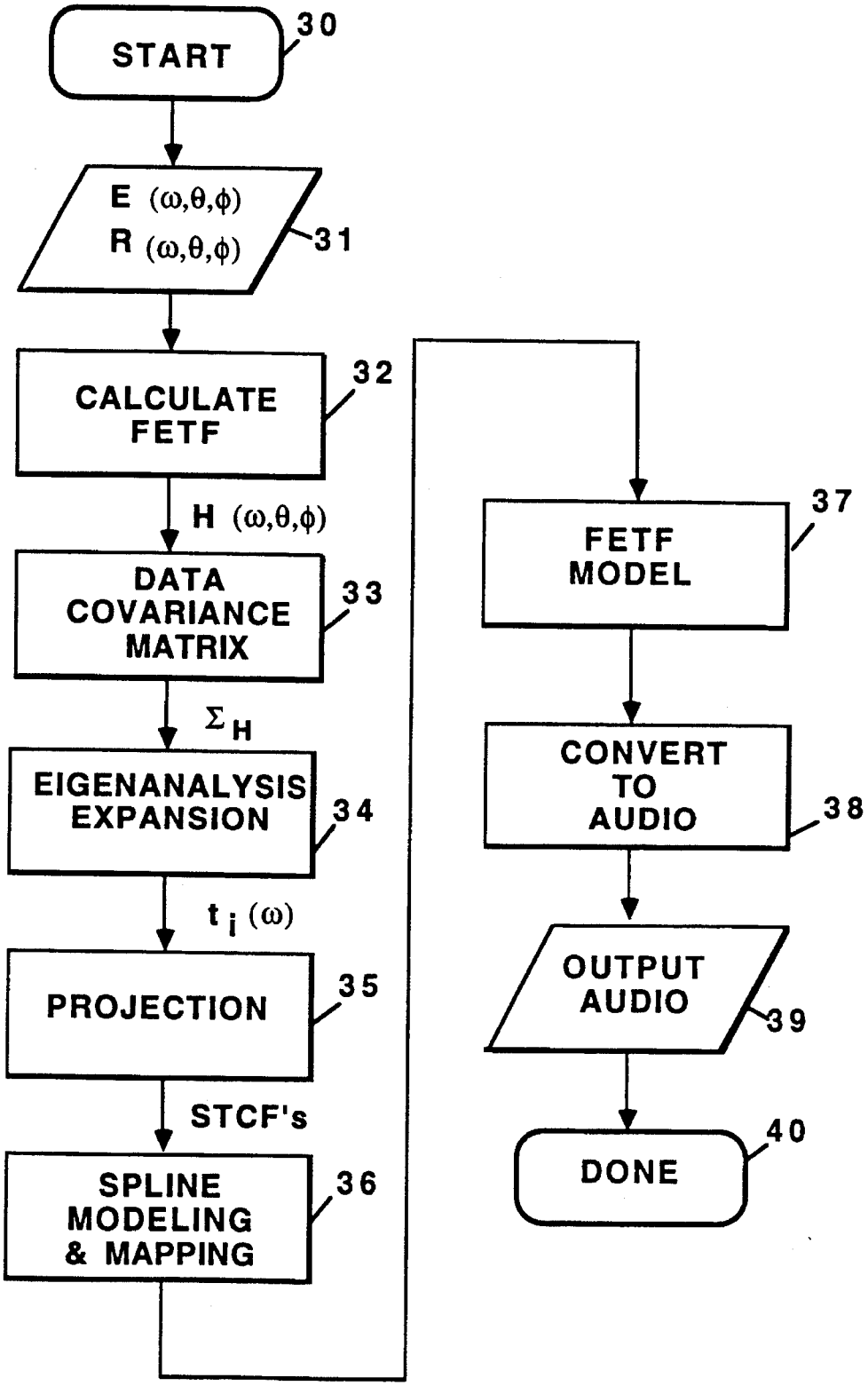
FIG. 4 is a flow chart showing the steps in producing a sound according to the present invention.

FIG. 4 illustrates how sound data collected in FIGS. 1–3 is processed to determine the basic filters and weights used to impart spatial characteristics to sound according to the present invention. The sound data has been input and stored for a plurality of specific speaker locations, as many as 2000 or more, for both free field, $R(\omega, \theta, \phi)$, and ear canal recording, $E(\omega, \theta, \phi)$. This is represented by input block 31 in FIG. 4. This data typically contains noise, measurement errors and artifacts from the detection of sound. Conventional, known signal processing techniques are used to develop a free-field-to-ear transfer function $H(\omega, \theta, \phi)$, as represented by process block 32 in FIG. 4, which is a function of frequency $\omega$, at some azimuth $\theta$ and some elevation $\phi$. This block 32 is executed by a program written in MATLAB and C programming language running on a SUN/SPARC 2 computer. MATLAB™, version 3.5, is available from the Math Works, Inc., Natick, Mass. A similar program could be written for the AT-compatible computer 20 or other computers to execute this block.

If $H(\omega, \theta, \phi)$ is the measured FETF at some azimuth $\theta$ and elevation $\phi$, the overall model response, $\hat{H}(\omega, \theta, \phi)$, can be expressed as the following equation:

$$\hat{H}(\omega,\theta,\phi) = \sum_{i=1}^{p} t_i(\omega) w_i(\theta,\phi) + t_o(\omega) \tag{1}$$

Note that the model separates frequency-dependence characterized by the basic filters, represented by $t_i(\omega)$(i= 0, 1, . . . , p), also referred to as eigenfilters (EF's), from the spatial-dependence represented by weights, $w_i(\theta, \phi)$ (i= 1, . . . , p). These weights are termed spatial transformation characteristic functions (STCF's). This provides a two-step procedure for determining $\hat{H}(\omega, \theta, \phi)$ provided that the above equation can be solved for $t_i(\omega)$ and $w_i(\theta, \phi)$.

The present invention provides the methods and apparatus to determine EF's and STCF's, so that the model response $\hat{H}(\omega, \theta, \phi)$ is a good approximation to $H(\omega, \theta, \phi)$.

In practical digital signal processing instruments, discrete sampled quantities must be utilized. The discrete version of the model response can be conveniently represented using vector notation, where vectors are represented in boldface.

Let $H(\theta, \phi)$ and $t_i$ be N dimensional vectors whose elements are N samples in frequency of the measured FETF°s, $H(\omega, \theta, \phi)$, and N samples in frequency of the eigenfilters $\{t_i(\omega), i=0,1, \ldots, p\}$. The value for N is typically 256 although larger or smaller values could also be used. N should be sufficiently large so that the eigenfilters are well described by the samples of $t_i(\omega)$. The sampled modeled response filter function can be represented in vector form as $$\hat{H}(\theta,\phi) = \sum_{i=1}^{p} t_i w_i(\theta,\phi) + t_o \tag{1'}$$

where $\hat{H}(\theta,\phi)$, $t_i$, and $t_o$ are N dimensional vectors. The eigenfilters $\{t_i, i=1,2 \ldots, p\}$ are chosen as eigenvectors corresponding to the p largest eigenvalues of a sample covariance matrix $\Sigma_H$ formed from the spatial samples of the FETF frequency vectors $H(\theta, \phi)$. The eigenfilter $t_o$ is chosen as the sample mean $\bar{H}$ formed from the spatial samples of FETF frequency vectors $H(\theta, \phi)$. If $H(\theta_j, \phi_k)$ represents the measured FETF at the azimuth elevation pair $(\theta_j, \phi_k)$ and providing that j=1, . . . , L, k=1, . . . , M, where L×M is on the order of 2000, the covariance matrix $\Sigma_H$ of FETF samples is given by $$\Sigma_H = \frac{1}{LM} \sum_{j=1}^{L} \sum_{k=1}^{M} \alpha_{jk} (H(\theta_j,\phi_k) - \bar{H})(H(\theta_j,\phi_k) - \bar{H})^H \tag{2}$$

where $\bar{H}$, the sample mean, is expressed as follows:

$$\bar{H} = \frac{1}{LM} \sum_{j=1}^{L} \sum_{k=1}^{M} H(\theta_j,\phi_k) \tag{3}$$

In equation (2) the superscript "H" denotes a complex conjugate transpose operation. The non-negative weighting factor $\alpha_{jk}$ is used to emphasize the relative importance of some directions over others. If all directions are equally important, $\alpha_{jk}=1$, for j=1, . . . ,. L, k =1, . . . , M.

The EF vectors $\{t_i$ (i=1, 2, . . . , p)$\}$ satisfy the following eigenvalue problem $$\Sigma_H t_i = \lambda_i t_i \tag{4}$$

where i=1, . . . , p and where $\lambda_i$ are the "p" largest eigenvalues of $\Sigma_H$. The fidelity of sound reproduced using the methodology of the invention is improved by increasing "p". A typical value for "p" is 16. The EF vector, $t_0$ is set equal to H.

The STCF's $w_i(\theta,\phi)$, i=1, . . . , p, are obtained by fitting a spline function over azimuth and elevation variables to STCF samples, $\tilde{w}_i(\theta_j,\phi_k)$, i=1, . . . , p, j=1, . . . , L, k=1, . . . , M, which are chosen to minimize the squared error between the calculated values and measured values of FETF's at locations $(\theta_j,\phi_k)$ j=1, . . . , L, k=1, . . . , M. The samples $\tilde{w}_i(\theta_j,\phi_k)$ that minimize the squared error are given $$\tilde{w}_i(\theta_j,\phi_k)=t_i^H\,H(\theta_j,\phi_k) \tag{5}$$

where i=1, . . . , p, j=1, . . . , N, k=1, . . . , M. Here we assume without loss of generality that the $t_i$ has a unit norm, that is, $t_i^H\,t_i=1$, i=1, . . . , p.

The spline model for generating the STCF's smooths measurement noise and enables interpolation of the STCF's (and hence the FETF's) between measurement directions. The spline model is obtained by solving the regularization problem $$\min_{w_i(\theta,\phi)} \sum_{j=1}^{L}\sum_{k=1}^{M} (\tilde{w}_i(\theta_j,\phi_k)-w_i(\theta_j,\phi_k))^2+\lambda|Pw_i(\theta,\phi)|^2 \tag{6}$$

where i=1, . . . , p. Here $w_i(\theta_j,\phi_k)$ is the functional representation of the ith STCF, $\lambda$ is the regularization parameter, and P is a smoothing operator.

The regularization parameter controls the trade-off between the smoothness of the solution and its fidelity to the data. The optimal value of $\lambda$ is determined by the method of generalization cross validation. Viewing $\theta$ and $\phi$ as coordinates in a two dimensional rectangular coordinate system, the smoothing operator P is $$|Pw_i(\theta,\phi)|^2=\int_R d\theta d\phi\left\{\left[\frac{\partial^2 w(\theta,\phi)}{\partial\theta^2}\right]^2+2\left[\frac{\partial^2 w(\theta,\phi)}{\partial\theta\partial\phi}\right]^2+\left[\frac{\partial^2 w(\theta,\phi)}{\partial\phi^2}\right]^2\right\} \tag{7}$$

The regularized STCF's are combined with the EF's to synthesize regularized FETF's at any given $\theta$ and $\phi$.

Process block 33 in FIG. 4 represents the calculation of $\Sigma_H$, which is performed by a program in the MATLAB™ language running on the SUN/SPARC 2 computer. A similar program could be written for the AT-compatible computer 20 or another computer to execute this block.

Next, as represented by process block 34 in FIG. 4, an eigenvector expansion is applied to the $\Sigma_H$ results to calculate the eigenvalues, $\lambda_i$, and eigenvectors $t_i$. In this example, the eigenanalysis is more specifically referred to as the Karhunen-Loeve expansion. For further explanation of this expansion, reference is made to Papoulis, *Probability, Random Variables and Stochastic Processes,* 3d ed. McGraw-Hill, Inc., New York, N.Y., 1991, pp. 413–416, 425. The eigenvectors, are then processed, as represented by block 35 in FIG. 4, to calculate the samples of the STCF's, $w_i$ as a function of spatial variables $(\theta, \phi)$ for each direction from which the sound has been measured, as described in equation 5 above. This calculation is performed by a program in the MATLAB™ language running on the SUN/SPARC computer. A similar program could be written for the AT-compatible computer 20 or a different computer to execute this block.

Next, as represented by process block 36 in FIG. 4, a generalized spline model is fit to the STCF samples using a publicly available software package known as RKpack, obtained through E-mail at netlib@Research.att.com.. The spline model filters out noise from each of the sampled STCF's. The spline-based STCF's are now continuous functions of the spatial variables $(\theta, \phi)$.

The surface mapping and filtering provides resulting data which permits interpolation of the STCF's between measured points in spherical space. The EF's $t_0$ and $t_i$, and the STCF's, $w_i(\theta, \phi)$, i=1, .. . , p, describe the completed FETF model as represented in process block 37. An FETF for a selected direction is then synthesized by weighting and summing the EF's with the smoothed and interpolated STCF's. A directional sound is synthesized by filtering a non-directional sound with the FETF as represented by process block 38.

The synthesized sound is converted to an audio signal, as represented by process block 39, and converted to sound through a speaker, as represented by output block 40. This completes the method as represented by block 41.

Figure 5A:
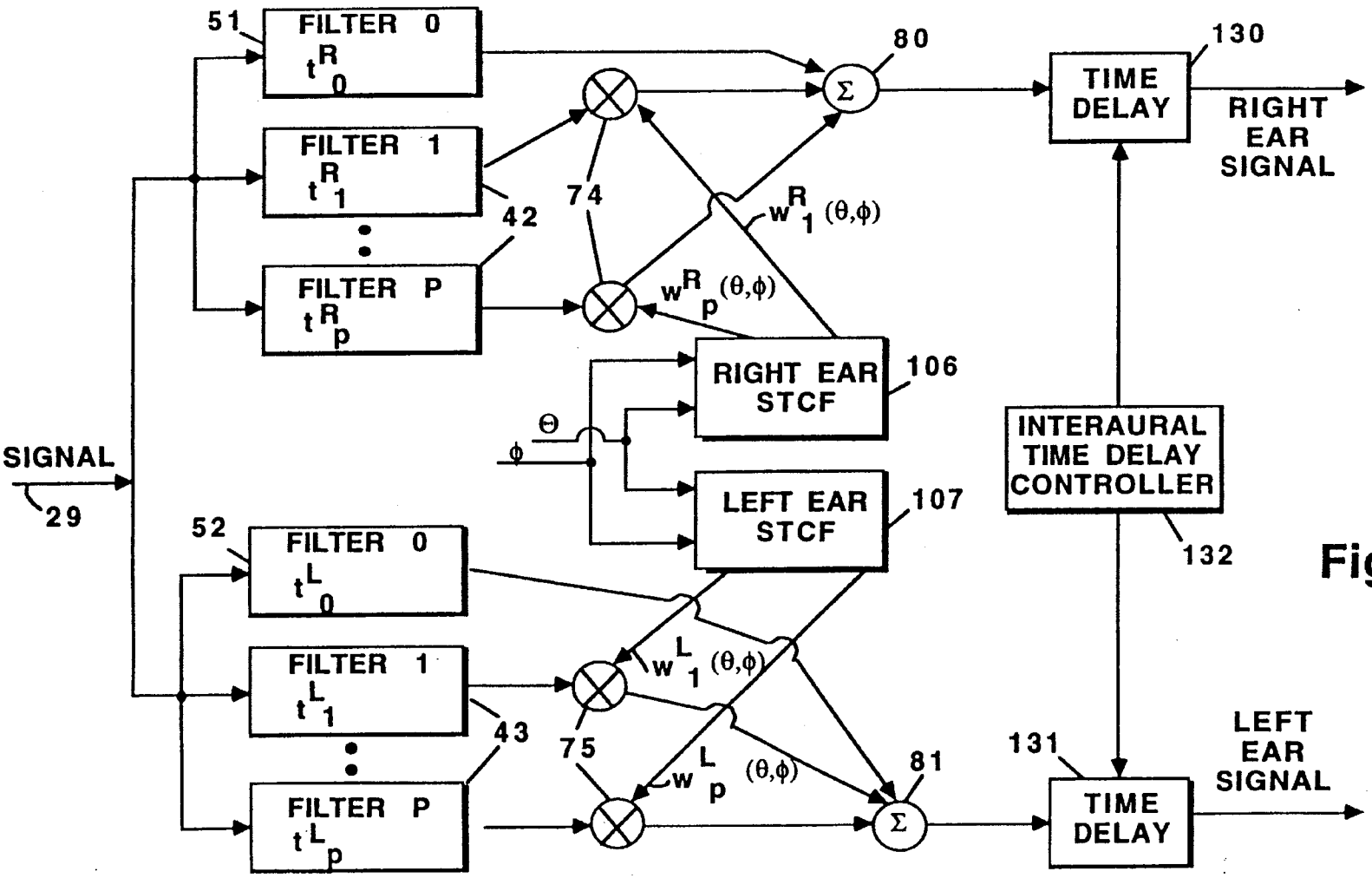
FIG. 5*a* is a functional circuit diagram showing how a directional sound is synthesized with the apparatus of FIG. 6.

FIG. 5*a* is a block diagram showing how a directional sound is synthesized according to the present invention. A non-directional sound represented by input signal 29 in FIG. 5 is played back through a variable number, p, of filters 42 corresponding to a variable number, p, of EF's for the right ear and a variable number, p, of filters 43 for the left ear. In this embodiment p=16 is assumed for illustrative purposes. The signal coming through each of these sixteen filters 42 is amplified according to the SCTF analysis of data, represented by blocks 106, 107 as a function of spatial variables $\theta$ and $\phi$, as outlined above, for each ear as represented by sixteen multiplying junctions 74 for the right ear and sixteen multiplying junctions 75 for the left ear. The input signal 29 is also filtered by the FETF sample mean value, $t_0$, represented by blocks 51, 52 in FIG. 5*a,* and then amplified by a factor of unity (1). The amplified and EF filtered component signals are then summed with each other and with the zero-frequency components 51, 52 at summing junctions 80 and 81, for right and left ears, respectively, and played back through headphones to a listener in a remote location. By weighting the EF filtered signals with the STCF weights corresponding to a selected direction defined by $\theta$ and $\phi$, and summing the weighted filtered signals, a sound was produced with the effect that the sound was originating from the selected direction.

Figure 5B:
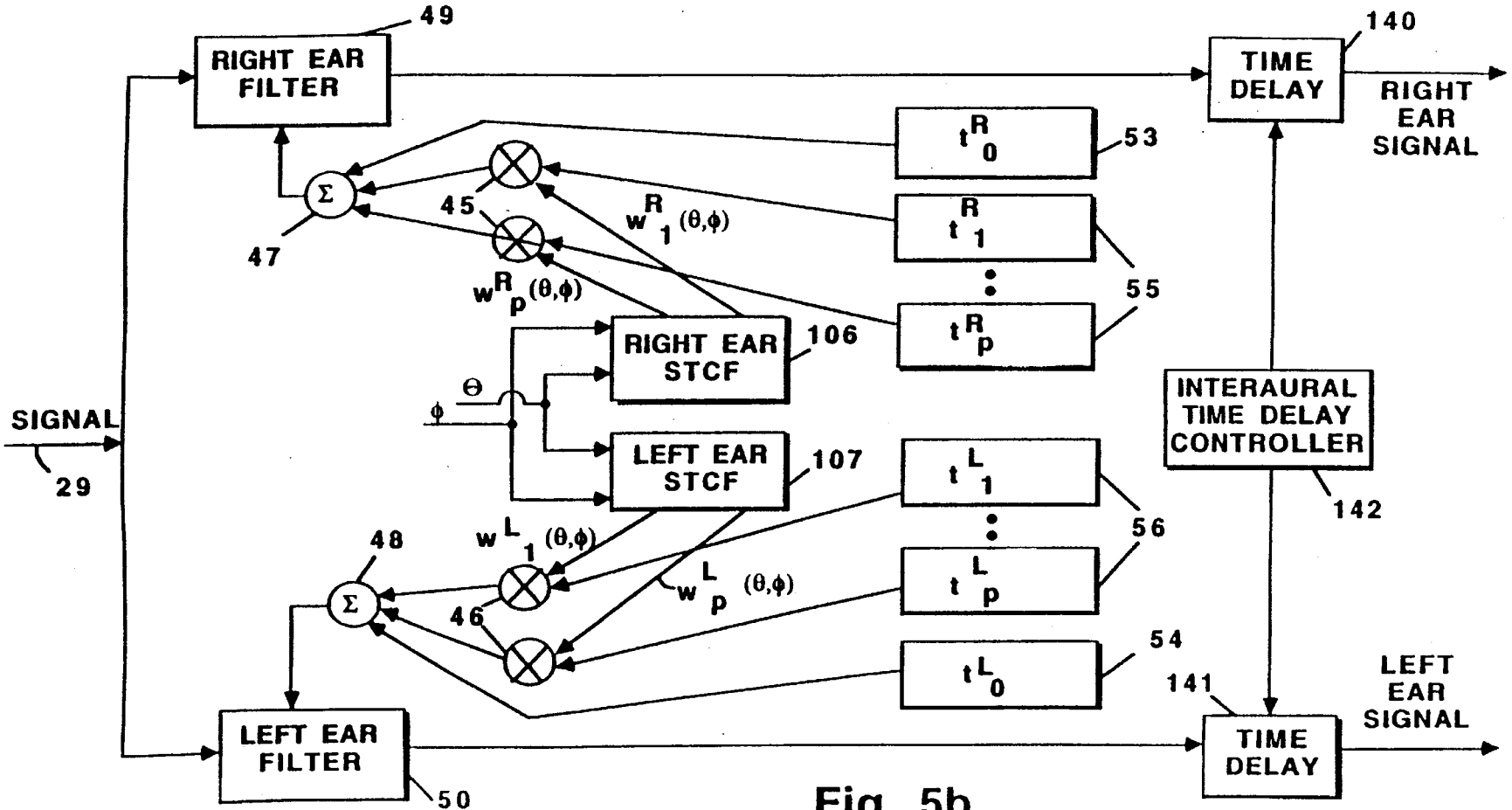
FIG. 5*b* is a functional circuit diagram showing a second method for synthesizing sound with the apparatus of FIG. 6.

FIG. 5*b* shows an alternative approach to synthesize directional sound according to the present invention. Here the non-directional input signal 29 is filtered directly by the FETF for the selected direction. The FETF for the selected direction is obtained by weighting the EF's 55, 56 at "p" multiplying junctions 45, 46 with the STCF's 106, 107 for the selected direction. Then, the adjusted EF's are summed at summing junctions 47, 48, together with the FETF sample mean value, $t_0$, represented by elements 55, 56, to provide a single filter 49, 50 for each respective ear with a response characteristic for the selected direction of the sound.

In the above examples, the filtering of components is performed in the frequency domain, but it should be apparent that equivalent examples could be set up to filter components in the time domain, without departing from the scope of the invention. As is readily apparent, the inverse Fourier transform of both sides of equation (1) (and corresponding discrete version equation (1')) yields the impulse responses for the basic filters. Since the weighting factors $w_i(\theta,\phi)$ are not functions of frequency, they are not affected by the inverse transform and thus the impulse response form of the basic filters has the same form as equation (1) with the spatially variant terms $w_i(\theta,\phi)$ separated from the timedependent terms in the impulse response. Of course, where the basic filters are implemented in the time domain rather than the frequency domain, the process of convolution is carried out on the input signal and the basic filters in impulse response form.

Both FIGS. 5*a* and 5*b* show a final stage which accounts for the interaural time delay. Since the interaural time delay was removed during the process of the modeling, it needs to be restored in the binaural implementation. The interaural time delay ranges from 0 to about 700 μs. The blocks 132 and 142 in FIGS. 5*a* and 5*b*, respectively, represent interaural time delay controllers. They convert the given location variables θ and ϕ into time delay control signals and send these control signals to both ear channels. The blocks 130, 131, 140 and 141 are delays controlled by the interaural time delay controllers 132, 142. The actual interaural time delay can be calculated by cross-correlating the two ear canal recordings vs. each sound source location. These discrete interaural time delay samples are then input into the spline model, thus a continuous interaural time delay function is acquired.

Figure 6:
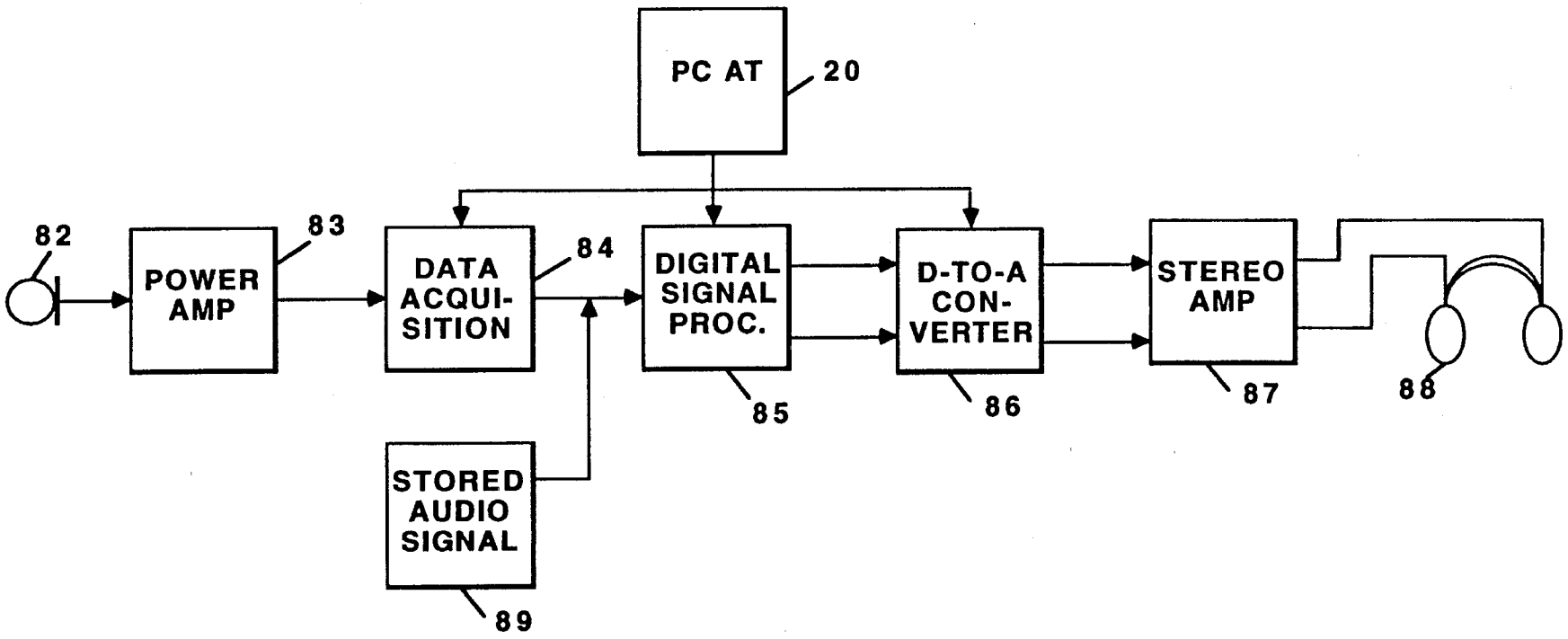
FIG. 6 is a block diagram showing apparatus for producing a directional sound according to the present invention.

FIG. 6 is a block diagram showing apparatus for producing the directional sound according to the present invention. The non-directional sound is recorded using a microphone 82 to detect the sound and an amplifier 83 and signal processing board 84–86 to digitize and record the sound. The signal processing board includes data acquisition circuitry 84, including analog-to-digital converters, a digital signal processor 85, and digital-to-analog output circuitry 86. The signal processor 85 and other sections 84, 86 are interfaced to the PC AT computer 20 or equivalent computer as described earlier. The digital-to-analog output circuitry 86 is connected to a stereo amplifier 87 and stereo headphones 88. The measured data for the FETF is stored in mass storage (not shown) associated with the computer 20. Element 89 illustrates an alternative in which an audio signal is prerecorded, stored and then fed to the digital signal processor 85 for production of directional sound.

The signal 29 in FIGS. 5*a* and 5*b* is received through microphone 82. The filtering by filters 42 and 43, and other operations seen in FIG. 5*a* and 5*b*, are performed in the digital signal processor 85 using EF's and STCF function data 106, 107 received from the AT-compatible computer 20 or other suitable computer.

The other elements 86–88 in FIG. 6 convert the audio signals seen FIG. 5 to sound which the listener observes as originating from the direction determined by selection of θ and ϕ in FIG. 5. That selection is carried out with the AT-compatible computer 20, or other suitable computer, by inputting data for θ and ϕ.

It should be apparent that this method can be used to make sound recordings in various media such as CD's, tapes and digitized sound recordings, in which non-directional sounds are converted to directional sounds by inputting various sets of values for θ and ϕ. With a series of varying values, the sound can be made to "move" relative to the listener's ears, hence, the terms "three-dimensional" sound and "virtual auditory environment" are applied to describe this effect.

This description has been by way of example of how the invention can be carried out. Those of ordinary skill in the art will recognize that various details may be modified in arriving at other detailed embodiments, and that many of these embodiments will come within the scope of the invention. Therefore to apprise the public of the scope of the invention and the embodiments covered by the invention the following claims are made.

We claim:

1. A method of modifying a signal representing a sound which is to be applied as a sound to a listener's ear to simulate the origin of that sound at a selected position in space with respect to the listener's ear, comprising the steps of:

(a) measuring the filter function for sound originating from a sound source at a plurality of discrete positions in the space surrounding an origin position at which the sound is measured, the measurement position corresponding to the position of a listener's ear;

(b) determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time;

(c) applying the filter function for a selected position as a filter to the signal representing sound to produce a filtered signal; and (d) converting the filtered signal to a sound and applying the sound to the ear of a listener.

2. The method of claim 1 wherein the step of applying the sound to the ear of a listener is carried out using an earphone at the ear of the listener.

3. The method of claim 1 wherein the step of applying sound is carried out using an earphone at each ear of the listener.

4. The method of claim 3 including the step of providing an appropriate time delay between the sound applied to the two earphones at the two ears of the listener.

5. A method of modifying a signal representing a sound which is to be applied as a sound to a listener's ear to simulate the origin of that sound at a selected position in space with respect to the listener's ear, comprising the steps of:

(a) measuring the filter function for sound originating from a sound source at a plurality of discrete positions in the space surrounding an origin position at which the sound is measured, the measurement position corresponding to the position of a listener's ear;

(b) determining a model filter function for each position at which sound originates which approximates in both magnitude and phase the actual measured filter function at each position, the model filter function formed as a sum of a selected number of basic filter functions which are functions only..of frequency or time and not of position, with each basic filter function multiplied by a weighting factor for that basic filter function which is a function only of the position at which the sound originated and not of frequency or time;

(c) applying the filter function for a selected position as a filter to the signal representing sound to produce a filtered signal; and (d) converting the filtered signal to a sound and applying the sound to the ear of a listener;

wherein the model filter functions are determined for a selected number N of samples in frequency of the measured filter functions, and wherein the model filter function for an azimuth position θ and an elevation position ϕ of sound origination in a spherical coordinate system about the position of sound measurement as the origin has the form $$\hat{H}(\theta,\phi) = \sum_{i=1}^{p} t_i w_i(\theta,\phi) + t_o$$

where the model filter function $\hat{H}(\theta,\phi)$ is an N dimensional vector, $t_i$ is an N dimensional vector representing the basic filter functions, $w_i(\theta,\phi)$ are the weighting factors, and p is a selected number of basic filter functions.

6. The method of claim 5 wherein steps (b) through (d) are repeated for different values of azimuth position $\theta$ and elevation position $\phi$ such that the sound applied to the ear of the listener is made to appear to move over time relative to the listener's ears.

7. A method of modifying a signal representing a sound which is to be applied as a sound to a listener's ear to simulate the origin of that sound at a selected position in space with respect to the listener's ear, comprising the steps of:

(a) measuring the filter function for sound originating from a sound source at a plurality of discrete positions in the space surrounding an origin position at which the sound is measured, the measurement position corresponding to the position of a listener's ear;

(b) determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time, wherein the model filter functions are determined for a selected number N of samples in frequency of the measured filter functions, and wherein the model filter function for an azimuth position $\theta$ and an elevation position $\phi$ of sound origination in a spherical coordinate system about the position of sound measurement as the origin has the form $$\hat{H}(\theta,\phi) = \sum_{i=1}^{p} t_i w_i(\theta,\phi) + t_o$$

where the model filter function $\hat{H}(\theta,\phi)$ is an N dimensional vector, $t_i$ is an N dimensional vector representing the basic filter functions, $w_i(\theta,\phi)$ are the weighting factors, and p is a selected number of basic filter functions;

(c) applying the filter function for a selected position as a filter to the signal representing sound to produce a filtered signal; and (d) converting the filtered signal to a sound and applying the sound to the ear of a listener, wherein the step of determining a model filter function $\hat{H}(\theta,\phi)$ includes the steps of:

(1) forming for the selected number N an N dimensional vector $H(\theta_j,\phi_k)$ having elements which are N samples in frequency of the measured filter functions at the measured positions $(\theta_j,\phi_k)$, where j=1, . . . , L, k=1, . . . , M, and L and M are the total number of azimuth and elevation positions, respectively, at which measurements were made;

(2) forming a covariance matrix $\Sigma_H$ as $$\Sigma_H = \frac{1}{LM} \sum_{j=1}^{L} \sum_{k=1}^{M} \alpha_{j,k}[H(\theta_j,\phi_k) - \overline{H}] \cdot [H(\theta_j,\phi_k) - \overline{H}]^H$$

where H is the sample mean determined as:

$$\overline{H} = \frac{1}{LM} \sum_{j=1}^{L} \sum_{k=1}^{M} H(\theta_j,\phi_k)$$

and where the superscript "$H$" denotes the complex conjugate transpose of the matrix and $\alpha_{j,k}$ is a selected non-negative weighting factor;

(3) determining the basic filter functions $t_i$, i=1, 2, . . . , p, to satisfy the relation:

$$\Sigma_H t_i = \lambda_i t_i$$

where $\lambda_i$, i=1, 2, . . . , p, are the "p" largest eigenvalues of the matrix $\Sigma_H$ and wherein $t_o$=H.

8. The method of claim 7 wherein the weighting factors $\tilde{w}_i(\theta_j,\phi_k)$ at the measured positions $\theta_j$, $\phi_k$ are determined as $$\tilde{w}_i(\theta_j,\phi_k) = t_i^H H(\theta_j,\phi_k)$$

where i=1, . . . , p, j=1, . . . , L, k=1, . . . , m, and superscript "H" denotes complex conjugate vector transpose, and the magnitude of $t_i$ is chosen such that $t_i^H t_i$=1, . . . , p.

9. A method of modifying a signal representing a sound which is to be applied as a sound to a listener's ear to simulate the origin of that sound at a selected position in space with respect to the listener's ear, comprising the steps of:

(a) measuring the filter function for sound originating from a sound source at a plurality of discrete positions in the space surrounding an origin position at which the sound is measured, the measurement position corresponding to the position of a listener's ear;

(b) determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time;

(c) determining an interpolated model filter function for sound originating at a selected position between positions at which measurements were made which has the same form as the model filter functions determined for the measured positions including the same basic filter functions and with the weights for the basic filter functions determined as an interpolated function of the weights for the model filter functions at the measured positions;

(d) applying the interpolated model filter function for the selected position as a filter to the signal representing sound to produce a filtered signal; and (e) converting the filtered signal to a sound and applying the sound to the ear of a listener;

wherein the model filter functions are determined for a selected number N of samples in frequency of the measured filter functions, and wherein the model filter function for an azimuth position $\theta$ and an elevation position $\phi$ of sound origination in a spherical coordinate system about the position of sound measurement as the origin has the form $$\hat{H}(\theta,\phi) = \sum_{i=1}^{p} t_i w_i(\theta,\phi) + t_o$$

where the model filter function $\hat{H}(\theta,\phi)$ is an N dimensional vector, $t_i$ is an N dimensional vector representing the basic filter functions, $w_i(\theta,\phi)$ are the weighting factors, and p is a selected number of basic filter functions.

10. The method of claim 9 wherein steps (b) through (e) are repeated for different values of azimuth position $\theta$ and elevation position $\phi$ such that the sound applied to the ear of the listener is made to appear to move over time relative to the listener's ears.

11. A method of modifying a signal representing a sound which is to be applied as a sound to a listener's ear to simulate the origin of that sound at a selected position in space with respect to the listener's ear, comprising the steps of:

(a) measuring the filter function for sound originating from a sound source at a plurality of discrete positions in the space surrounding an origin position at which the sound is measured, the measurement position corresponding to the position of a listener's ear;

(b) determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time;

(c) determining an interpolated model filter function for sound originating at a selected position between positions at which measurements were made which has the same form as the model filter functions determined for the measured positions including the same basic filter functions and with the weights for the basic filter functions determined as an interpolated function of the weights for the model filter functions at the measured positions;

(d) applying the interpolated model filter function for the selected position as a filter to the signal representing sound to produce a filtered signal; and (e) converting the filtered signal to a sound and applying the sound to the ear of a listener.

12. The method of claim 11 wherein the step of applying the sound to the ear of a listener is carried out using an earphone at the ear of the listener.

13. The method of claim 11 wherein the step of applying sound is carried out using an earphone at each ear of the listener.

14. The method of claim 13 including the step of providing an appropriate time delay between the sound applied to the two earphones at the two ears of the listener.

15. A method of modifying a signal representing a sound which is to be applied as a sound to a listener's ear to simulate the origin of that sound at a selected position in space with respect to the listener's ear, comprising the steps of:

(a) measuring the filter function for sound originating from a sound source at a plurality of discrete positions in the space surrounding an origin position at which the sound is measured, the measurement position corresponding to the position of a listener's ear;

(b) determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time, wherein the model filter functions are determined for a selected number N of samples in frequency of the measured filter functions, and wherein the model filter function for an azimuth position $\theta$ and an elevation position $\phi$ of sound origination in a spherical coordinate system about the position of sound measurement as the origin has the form $$\hat{H}(\theta,\phi) = \sum_{i=1}^{p} t_i w_i(\theta,\phi) + t_o$$

where the model filter function $\hat{H}(\theta,\phi)$ is an N dimensional vector, $t_i$ is an N dimensional vector representing the basic filter functions, $w_i(\theta,\phi)$ are the weighting factors, and p is a selected number of basic filter functions;

(c) determining an interpolated model filter function for sound originating at a selected position between positions at which measurements were made which has the same form as the model filter functions determined for the measured positions including the same basic filter functions and with the weights for the basic filter functions determined as an interpolated function of the weights for the model filter functions at the measured positions;

(d) applying the interpolated model filter function for the selected position as a filter to the signal representing sound to produce a filtered signal; and (e) converting the filtered signal to a sound and applying the sound to the ear of a listener;

wherein the step of determining a model filter function $\hat{H}(\theta,\phi)$ includes the steps of:

(1) forming for the selected number N, an N dimensional vector $H(\theta_j,\phi_k)$ having elements which are N samples in frequency of the measured filter functions at the measured positions $(\theta_j,\phi_k)$, where j=1, . . . , L, k=1, . . . , M, and L and M are the total number of azimuth and elevation positions, respectively, at which measurements were made;

(2) forming a covariance matrix $\Sigma_H$ as $$\Sigma_H = \frac{1}{LM} \sum_{j=1}^{L} \sum_{k=1}^{M} \alpha_{j,k} [H(\theta_j,\phi_k) - \overline{H}] \cdot [H(\theta_j,\phi_k) - \overline{H}]^H$$

where H is the sample mean determined as:

$$\overline{H} = \frac{1}{LM} \sum_{j=1}^{L} \sum_{k=1}^{M} H(\theta_j,\phi_k)$$

and where the superscript "$^H$" denotes the complex conjugate transpose of the matrix and $\alpha_{j,k}$ is a selected non-negative weighting factor;

(3) determining the basic filter functions $t_i$, i=1, 2, . . . , p, to satisfy the relation:

$$\Sigma_H t_i = \lambda_i t_i$$

where $\lambda_i$, i=1, 2, . . . , p, are the "p" largest eigenvalues of the matrix $\Sigma_H$ and wherein $t_o$=H.

16. The method of claim 15 wherein the weighting factors $\tilde{w}_i(\theta_j,\phi_k)$ at the measured positions $\theta_j$, $\phi_k$ are determined as $$\tilde{w}_i(\theta_j,\phi_k)=t_i^H H(\theta_j,\phi_k)$$

where i=1, . . . , p, j=1, . . . , L, k=1, . . . , m, and superscript "$^H$" denotes complex conjugate vector transpose, and the magnitude of $t_i$ is chosen such that $t_i^H t_i=1$, i=1, . . . , p.

17. The method of claim 16 wherein the step of interpolating weights $w_i(\theta,\phi)$ at positions θ and φ between the measured positions $\theta_j$, $\phi_k$ is determined by fitting a spline function to the measured position weights $\tilde{w}_i(\theta_j,\phi_k)$, j=1, . . . , L,k=1, . . . , M.

18. The method of claim 17 wherein the spline function is fitted to produce a weighting function $w_i$ (θ,φ) obtained by solving the expression $$\min_{w_i(\theta,\phi)} \sum_{j=1}^{L}\sum_{k=1}^{M} (\tilde{w}_i(\theta_j,\phi_k) - w_i(\theta_j,\phi_k))^2 + \lambda|P(w_i(\theta,\phi))|^2$$

where i=1, . . . , p, λ is a selected scalar regularization parameter, and P is a selected smoothing operator.

19. Apparatus for providing sound to a listener's ear which simulates the origin of that sound at a selected position in space with respect to the listener's ear, comprising:

(a) means for providing a signal representing a sound;

(b) means for applying a filter to the signal representing the sound to provide a filtered signal, the filter comprising an interpolated model filter function for the selected position which is determined by measuring the filter function for sound originating from a sound source at a plurality of discrete positions in the space surrounding an origin position at which the sound is measured, the measurement position corresponding to the position of a listener's ear, determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time, and determining an interpolated model filter function for sound originating at the selected position between positions at which measurements were made which has the same form as the model filter functions determined for the measured positions including the same basic filter functions and with the weights for the basic filter functions determined as an interpolated function of the weights for the model filter functions at the measured positions; and (c) means for converting the filtered signal to a sound and applying the sound to the ear of a listener.

20. The apparatus of claim 19 wherein the means for converting the filtered signal and applying the sound comprises an earphone at the ear of the listener.

21. The apparatus of claim 19 wherein the means for converting the filter signal and applying the sound comprises an earphone at each ear of the listener.

22. The apparatus of claim 21 wherein the means for filtering includes means for providing an appropriate time delay between signals converted by two earphones to sounds at the two ears of the listener.

23. Apparatus for providing sound to a listener's ear which simulates the origin of that sound at a selected position in space with respect to the listener's ear, comprising:

(a) means for providing a signal representing a sound;

(b) means for applying a filter to the signal representing the sound to provide a filtered signal, the filter comprising an interpolated model filter function for the selected position which is determined by measuring the filter function for sound originating from a sound source at a plurality of discrete positions in the space surrounding an origin position at which the sound is measured, the measurement position corresponding to the position of a listener's ear, determining a model filter function for each position at which sound originates which approximates in both magnitude and phase the actual measured filter function at each position, the model filter function formed as a sum of a selected number of basic filter functions which are functions only of frequency or time and not of position, with each basic filter function multiplied by a weighting factor for that basic filter function which is a function only of the position at which the sound originated and not of frequency or time, and determining an interpolated model filter function for sound originating at the selected position between positions at which measurements were made which has the same form as the model filter functions determined for the measured positions including the same basic filter functions and with the weights for the basic filter functions determined as an interpolated function of the weights for the model filter functions at the measured positions; and (c) means for converting the filtered signal to a sound and applying the sound to the ear of a listener;

wherein the model filter functions are determined for a selected number N of samples in frequency of the measured filter functions, and wherein the model filter function for an azimuth position θ and an elevation position φ of sound origination in a spherical coordinate system about the position of sound measurement as the origin has the form $$\hat{H}(\theta,\phi) = \sum_{i=1}^{p} t_i w_i(\theta,\phi) + t_o$$

where the model filter function $\hat{H}(\theta,\phi)$ is an N dimensional vector, $t_i$ is an N dimensional vector representing the basic filter functions, $w_i(\theta,\phi)$ are the weighting factors, and p is a selected number of basic filter functions.

24. Apparatus for providing sound to a listener's ear which simulates the origin of that sound at a selected position in space with respect to the listener's ear, comprising:

(a) means for providing a signal representing a sound;

(b) means for applying a filter to the signal representing the sound to provide a filtered signal, the filter comprising an interpolated model filter function for the selected position which is determined by measuring the filter function for sound originating from a sound source at a plurality of discrete positions in the space surrounding an origin position at which the sound is measured, the measurement position corresponding to the position of a listener's ear, determining a model filter function for each position at which sound originates which approximates in both magnitude and phase the actual measured filter function at each position, the model filter function formed as a sum of a selected number of basic filter functions which are functions only of frequency or time and not of position, wherein the model filter functions are determined for a selected number N of samples in frequency of the measured filter functions, and wherein the model filter function for an azimuth position θ and an elevation position ϕ of sound origination in a spherical coordinate system about the position of sound measurement as the origin has the form $$\hat{H}(\theta,\phi) = \sum_{i=1}^{p} t_i w_i(\theta,\phi) + t_o$$

where the model filter function $\hat{H}(\theta,\phi)$ is an N dimensional vector, $t_i$ is an N dimensional vector representing the basic filter functions, $w_i(\theta,\phi)$ are the weighting factors, and p is a selected number of basic filter functions, with each basic filter function multiplied by a weighting factor for that basic filter function which is a function only of the position at which the sound originated and not of frequency or time, and determining an interpolated model filter function for sound originating at the selected position between positions at which measurements were made which has the same form as the model filter functions determined for the measured positions including the same basic filter functions and with the weights for the basic filter functions determined as an interpolated function of the weights for the model filter functions at the measured positions; and (c) means for converting the filtered signal to a sound and applying the sound to the ear of a listener;

wherein the model filter function $\hat{H}(\theta,\phi)$ is determined by forming for the selected number N, an N dimensional vector $H(\theta_j,\phi_k)$ having elements which are N samples in frequency of the measured filter functions at the measured positions $(\theta_j,\phi_k)$, where j=1, . . . , L, k=1, . . . , M, and L and M are the total number of azimuth and elevation positions, respectively, at which measurements were made, and forming a covariance matrix $\Sigma_H$ as $$\Sigma_H = \frac{1}{LM} \sum_{j=1}^{L} \sum_{k=1}^{M} \alpha_{jk}[H(\theta_j,\phi_k) - \overline{H}] \cdot [H(\theta_j,\phi_k) - \overline{H}]^H$$

where H is the sample mean determined as:

$$\overline{H} = \frac{1}{LM} \sum_{j=1}^{L} \sum_{k=1}^{M} H(\theta_j,\phi_k)$$

and where the superscript "$^H$" denotes the complex conjugate transpose of the matrix and $\alpha_{j,k}$ is a selected non-negative weighting factor, and determining the basic filter functions $t_i$, i=1, 2, . . . , p, to satisfy the relation:

$$\Sigma_H\, t_i = \lambda_i t_i$$

where $\lambda_i$ are the "p" largest eigenvalues of the matrix $\Sigma_H$ and wherein $t_o$=H.

25. The apparatus of claim 24 wherein the weighting factors $\tilde{w}_i(\theta_j,\phi_k)$ at the measured positions $\theta_j$, $\phi_k$ are determined as $$\tilde{w}_i(\theta_j,\phi_k) = t_i^H H(\theta_j,\phi_k)$$

where i=1, . . . , p, j=1, . . . , L, k=1, . . . , m, and superscript "$^H$" denotes complex conjugate vector transpose, and the magnitude of $t_i$ is chosen such that $t_i^H t_i = 1$, i=1, . . . , p.

26. The apparatus of claim 25 wherein the weights $w_i(\theta,\phi)$ at positions θ and ϕ between the measured positions $\theta_j$, $\phi_k$ are determined by a spline function fitted to the measured position weights $\tilde{w}_i(\theta_j,\phi_k)$, j=1, . . . , L, k=1, . . ., M.

27. The apparatus of claim 26 wherein the spline function is fitted to produce a weighting function $w_i(\theta,\phi)$ obtained by solving the expression $$\min_{w_i(\theta,\phi)} \sum_{j=1}^{L} \sum_{k=1}^{M} (\tilde{w}_i(\theta_j,\phi_k) - w_i(\theta_j,\phi_k))^2 + \lambda |P(w_i(\theta,\phi))|^2$$

where i=1, . . . , p, λ is a selected scalar regularization parameter, and P is a selected smoothing operator.

* * * * *

UNITED STATES PATENT AND TRADEMARK OFFICE

CERTIFICATE OF CORRECTION

PATENT NO. : 5,500,900

DATED : March 19, 1996

INVENTOR(S) : Jiashu Chen, et al.

It is certified that error appears in the above-indentified patent and that said Letters Patent is hereby corrected as shown below:

Title page, item [54] inventors:

The second-named inventor should read --Barry D. VanVeen-- instead of "Barry P. VanVeen" as written in the declaration submitted with the application and as reflected on the Filing Receipt.

In column 4, lines 29-30 of the application "FETF°s," should be --FETF's-- as written in the application on page 7, line 29.

In column 8, line 50 of the application, "only..of" should be --only of-- as per amendment dated June 5, 1995.

Signed and Sealed this

Twenty-second Day of October, 1996

*Attest:*

Bruce Lehman

BRUCE LEHMAN

*Attesting Officer*

*Commissioner of Patents and Trademarks*